US005137581A

United States Patent [19]

Takahashi

[11] Patent Number: 5,137,581

[45] Date of Patent: Aug. 11, 1992

[54] DEGREASING AND CLEANING METHOD AS WELL AS APPARATUS USED THEREFOR

[75] Inventor: Tsuneo Takahashi, Asaka, Japan

[73] Assignee: Oriental Engineering Co., Ltd., Arakawa, Japan

[21] Appl. No.: 720,402

[22] Filed: Jun. 25, 1991

[51] Int. Cl.[5] ..... B08B 3/00; B08B 5/04

[52] U.S. Cl. ..... 134/21; 134/30; 134/31; 134/35; 134/37; 134/40

[58] Field of Search ..... 134/19, 21, 30, 31, 134/34, 35, 36, 37, 40, 105, 200

[56] References Cited

U.S. PATENT DOCUMENTS

| | | | |
|---|---|---|---|
| 3,174,491 | 3/1965 | Faler | 134/105 |
| 3,613,699 | 10/1971 | Holm | 134/105 |
| 4,141,373 | 2/1979 | Kartanson et al. | 134/35 |
| 4,565,583 | 1/1986 | Venetta | 134/19 |
| 4,591,390 | 5/1986 | Scott et al. | 134/21 |

*Primary Examiner*—Theodore Morris
*Assistant Examiner*—Saud Chaudhry
*Attorney, Agent, or Firm*—Weintraub, DuRoss & Brady

[57] ABSTRACT

A degreasing and cleaning method for removing oils from an object includes the steps of heating an object deposited with oils in a container, jetting a cleaning liquid which is mainly water or steam into the container and subsequently evacuating the container to reduce the pressure in the inside of the container to thereby evaporate the deposited oils to remove them from the object. The degreasing and cleaning method can be conducted by an apparatus which includes a vacuum container having a heating means for heating an object deposited with oils, a jetting means for jetting the cleaning liquid into the vacuum container and an exhausting means for exhausting evaporated ingredients formed by steam distillation in the vacuum container therefrom.

6 Claims, 1 Drawing Sheet

DEGREASING AND CLEANING METHOD AS WELL AS APPARATUS USED THEREFOR

BACKGROUND OF THE INVENTION

1. Field of the Invention

The present invention concerns a method of degreasing and cleaning an object deposited with oils, as well as an apparatus used therefor. The present invention more particularly concerns such a method and apparatus which can be suitably utilized, for example, as a pre-cleaning in a heat treatment step or as an intermediate cleaning after a hardening step.

2. Description of the Prior Art

As examples of degreasing and cleaning methods which have been applied to metal materials deposited with oils, the following are known:

(1) Alkali cleaning: where cleaning is achieved by dipping the material into a warm aqueous solution or alcohol solution of sodium hydroxide or other alkali agent; or by spraying such a solution; alkali cleaning is applied to heavy oil contamination.

(2) Cleaning with a surface active agent: where cleaning is achieved by dipping the material into a warm aqueous solution of a surface active agent, or by spraying such a solution. Surface active agent cleaning is applied to slight deposition contamination or oil membranes.

(3) Cleaning with chloro-solvent: which involves dipping or vapor cleaning by using a chloro-solvent, such as, for example, 1,1,1-tri-chloroethane, trichloroethylene and perchloroethylene.

(4) Cleaning with a fluoro-solvent: which involves dipping or vapor cleaning, such as, for example, by using Freon 113.

However, degreasing and cleaning methods (1) and (2) using the alkali agent or the surface active agent are not generally employed since they involve problems. For example, cleaning performance is poor and quite often causes stains on the surface of an object to be cleaned. Likewise, liquid waste treatment is expensive.

On the other hand, degreasing and cleaning methods (3) and (4) using chloro-solvents or fluoro-solvents have high cleaning performance. However, the chloro-solvents involve problems since they show strong toxicity and evaporate greatly. Moreover, the chloro-solvents scatter from cleaning apparatus or treated objects owing to their volatility and thereby contaminate underground water as carcinogenic substances. Accordingly, legal regulations for their use have become more severe in recent years. Use of the fluoro-solvents has also been extremely restricted since they form ozone layer destructive substances when released to the atmosphere.

3. Object of the Invention

In view of the above, the present invention has been accomplished taking notice of the foregoing problems in the prior art. Therefore, it is an object hereof to provide a metal degreasing and cleaning method using neither alkali agent nor chloro- or fluoro-solvent which would result in public pollution or circumstantial contamination, as well as an apparatus used for the method.

SUMMARY OF THE INVENTION

The foregoing object of the present invention can be attained by a degreasing and cleaning method which comprises:

heating an object deposited with oils to be cleaned in a container;

spraying a cleaning liquid comprising substantially water or steam into the container; and subsequently evacuating the container to reduce the pressure in the inside thereof, thereby evaporating the deposited oils to remove them from the object to be cleaned.

The cleaning liquid in the present invention may be only water or steam. Further, the cleaning liquid may contain minor amounts of at least either a material capable of forming an azeotropic mixture with the oil to be removed or a surface active agent.

The degreasing and cleaning apparatus used for the method as described above according to the present invention comprises:

a vacuum container having a heating means for heating an object deposited with oils to be cleaned;

means for jetting a cleaning liquid comprising substantially water or steam into the vacuum container; and an evacuating means for evacuating evaporated ingredients formed by steam distillation in the vacuum container.

In the present invention, oils deposited on the object to be cleaned (hereinafter sometimes referred to simply as the object) are evaporated and removed by steam distillation under a reduced pressure. Further, tar components are, also cleaned with a jet of steam at a high temperature.

By mixing a material capable of forming an azeotropic mixture with the deposited oils into the cleaning liquid, the boiling point of the deposited oils can be lowered to promote their evaporation, thereby improving the degree of cleaning (degreasing ratio).

Further, by mixing a surface active agent with the cleaning liquid, separation of the deposited oils from the surface of the object can be promoted to further improve the degreasing ratio.

These and other objects, features and advantageous effects of the present invention will become apparent by reading the following description of the preferred embodiment according to the present invention with reference to the accompanying drawings, wherein:

DESCRIPTION OF THE ACCOMPANYING DRAWINGS

FIG. 1 is a schematic view illustrating a preferred embodiment of a degreasing and cleaning apparatus according to the present invention; and FIG. 2 is a chart illustrating an example of a treating step cycle in accordance with the present invention.

DESCRIPTION OF THE PREFERRED EMBODIMENT

Figure 1:
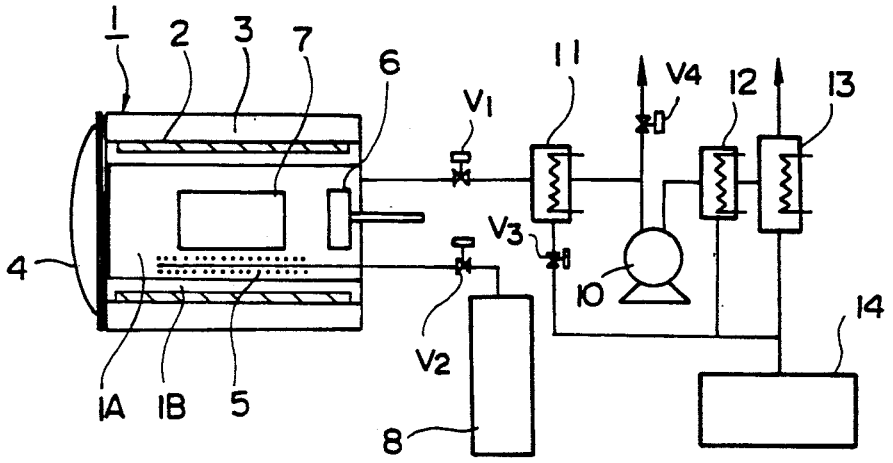

As noted hereinabove, in the present invention, water can be used alone as the cleaning liquid. Deposited oils are effectively removed from the object by steam distillation under a reduced pressure without using any organic solvent.

Further, a mixture of water and a solvent capable of forming an azeotropic mixture with oils, for example, methanol or benzene can be used. Mixing of such a solvent can lower the boiling point of the depositied oils to promote evaporation and enhance cleaning performance.

Further, a mixture of water with one or more of an anionic surface active agent, an nonionic surface active agent, a cationic surface active agent and an amphoteric surface active agent, as well as mixtures thereof, may be used. This can promote the separation of the deposited oils from the metal surface to enhance the cleaning performance.

Further, a mixture of water and a solvent capable of forming an azeotropic compound with oils may further be incorporated with several percent of the surface active agent described above. This can further enhance the cleaning performance.

The composition of the cleaning liquid is determined by considering the nature and the amount of the oils deposited on the object, required degree of cleanness or the like.

The cleaning liquid may be heated in a boiler and then sprayed in the form of steam into a vacuum container, or the cleaning liquid may be jetted in the form of an aqueous solution into a heated vacuum container to form the steam. In either case, the deposited oils are removed together with the steam by spraying or jetting the cleaning liquid and reducing the pressure.

The degree of pressure reduction in practicing the present invention is within a range about from several to 500 Torr although it differs depending on the amount and the kind of oils deposited to the object; the capacity of the exhaustion system and the like. If the pressure is reduced to such a high vacuum degree as to be lower than several Torrs, the cost of the exhaustion system for obtaining the required performance of the exhaustion system or the vacuum resistant performance of the container is increased relative to the degreasing effect so as not to be practical. On the other hand, at a lower vacuum degree of higher than 500 Torr, the degreasing efficiency is reduced markedly.

The heating temperature for the object to be cleaned is determined by considering the property of the deposited oils, the property of the object, restrictions in view of the processing step, etc. For instance, when using the present process for applying precleaning in a heat treatment step or as an intermediate cleaning after a hardening step, a temperature range from 100° C. to 250° C. is preferred. If the temperature is lower than 100° C., evaporation of the deposited oils (hardening oils) is insufficient. On the other hand, the upper limit is defined as lower than 250° C. since the degreasing treatment is applied at a temperature lower than that for tempering of the object.

The cycle for the degreasing and cleaning treatment in the present invention may be set in various ways. For instance, the cycle may comprise elevating the temperature in the inside of a container containing an object to be cleaned to a predetermined temperature; reducing the pressure in the container thereby pre-evaporating and removing relatively low boiling ingredients in the deposited oils; subsequently blowing or jetting steam, reducing the pressure, again, to evaporate and remove the remaining oils and, then, recovering the pressure to the initial level.

Alternatively, the cycle may comprise elevating the temperature in the inside of a container to a predetermined level; directly blowing or jetting steam into the container; subsequently reducing the pressure to evaporate and remove deposited oils and, then, recovering the pressure. The cycle can be properly set depending, for example, on the property of the deposition oils.

An apparatus for degreasing and cleaning according to the present invention is shown in the drawing. In the drawing, a cleaning apparatus main body 1 comprises a vacuum-tight vessel of structure comprising an inner chamber 1A and a heating chamber 1B disposed at the outer circumference thereof, a heat generating body 2, such as a heating burner, and a heat insulating material 3 for thermally insulating the outer circumference thereof.

An opening/closing door 4 is disposed at one end of the cleaning apparatus main body 1. A steam jetting nozzle 5 and a blower 6 are disposed in the inner chamber 1A for cleaning an object 7 contained in the chamber 1A.

The steam jetting nozzle 5 is connected to a boiler 8.

The exhaustion system for the chamber 1A comprises a water sealing vacuum pump 10. Heat exchangers 11 and 12 are disposed before and after the pump. A deep cold trap 13 is disposed downstream of the subsequent heat exchanger 12. An oil/water separation device 14 which is fluidly connected with drain pipelines for each of the heat exchangers 11, 12 and the deep cold trap 13. $V_1$, $V_2$, $V_3$ and $V_4$ denote ON/OFF solenoid valves, respectively.

As an exhausting or vacuum creating means for the degreasing and cleaning apparatus according to the present invention, a water sealing vacuum pump is, preferably, used. Since the exhaustion performance suffers from no undesired effect when a mixture of water and oils is sucked out, a continuous operation for a long period of time is possible under a vacuum degree maintained at a predetermined level.

Further, if a cold trap is disposed in the exhaustion system for recovering the evaporated and discharged oils by liquefication under cooling, effluence of separated oils can be effectively prevented.

EXAMPLE

Using the above-mentioned degreasing and cleaning apparatus, a degreasing and cleaning test was conducted for heat processing oils (corresponding to JIS class 1, No. 2 oil and class 2, No. 1 oil) deposited on an object to be cleaned.

Figure 2:
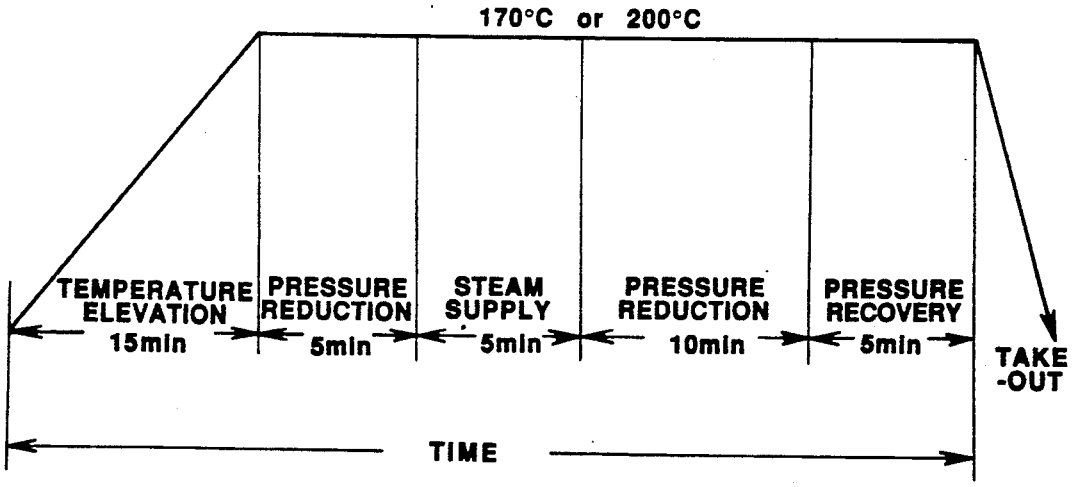

The processing cycle is shown in FIG. 2.

Cooling water at a normal temperature was previously caused to flow through each of the heat exchangers 11 and 12, while cold water at about 10° C. was caused to flow from a cooler (not illustrated) to the deep cold trap 13.

The object not yet treated was entered into the inner chamber 1A of the cleaning apparatus main body 1 by opening the opening/closing door 4 and was then heated by the heat generating body 2 by closing the opening/closing door 4. In this case, valves $V_1$, $V_3$ and $V_4$ were opened while the valve $V_2$ was kept closed.

The temperature distribution in the chamber was made uniform by operating the blower 6. When the temperature was elevated from room temperature to 170° C. in 15 minutes, relatively low boiling ingredients or components of the deposited oils were evaporated and then liquefied again by the heat exchanger 11. These low boiling ingredients were then sent, by way of the valve $V_3$, to the oil/water separation device 14 and stored therein. The unliquified gas was exhausted out of the system from the valve $V_4$.

Then, the valves $V_3$ and $V_4$ were closed and the water sealing vacuum pump 10 was operated to reduce the pressure at the inside of the inner chamber 1A to several Torrs. Subsequently, the valve V1 was closed while the valve $V_2$ was kept open to supply cleaning vapor comprising substantially steam from the boiler 8. This caused the pressure at the inside of the inner chamber 1A to recover substantially to a normal pressure. Subsequently, the valve $V_2$ was closed and the valve $V_1$ was opened to evacuate the inside of the inner chamber 1A to reduce the pressure to several Torrs. In this case, most of the oils deposited on the object were evaporated to conduct the cleaning. The evaporated oils and the water were, then, liquefied by cooling in the heat exchangers 11 and 12 and the deep cold trap 13, and, thereafter, stored in the oil/water separation device 14.

Ater reducing the pressure for 10 minutes, the operation of the water sealing vacuum pump 10 was interrupted and the pressure inside the inner chamber 1A was recovered to the atmospheric pressure by opening the valve $V_4$. Then the cleaned object was taken out of the chamber by opening the opening/closing door 4.

This test was repeated for various oils and pressures and temperatures. Table 1 shows the results of the test.

In the table, "none" indicated in the column for the steam source means comparative examples in which the cleaning treatment was conducted only by pressure reduction without blowing steam. In this case, the apparatus used had a vacuum container using an oil vacuum pump as the exhausting system, which was different from that previously described.

"A" for the steam source indicates a cleaning liquid comprising only water.

"B" for the steam source indicates a cleaning liquid comprising a mixture of water and 10% methanol.

"C" for the steam source indicates a cleaning liquid comprising a mixture of water, 10% methanol and 3% anionic surface active agent.

The results of the degreasing and cleaning were evaluated based on the state of the finished surface and the degreasing ratio of the object after treatment. For the state of the finished surface, those objects in which discoloration, due to the residue of tar components was observed were judged not good (NG).

The degreasing ratio was calculated based on the weight of a specimen with no deposition of oils and the weight of the oil-deposited specimen before and after the degreasing treatment. Those showing a degreasing ratio of greater than 90% were judged good (OK).

TABLE 1

| Kind of deposited oils | Steam source | Vacuum degree Torr | Temperature °C. | Time min | State of finished surface | Degreasing ratio % |
|---|---|---|---|---|---|---|
| Class 1, | none | 0.03 | 200 | 40 | NG | 91.1 |
| No. 2 | A | 5 | 170 | 40 | OK | 98.4 |
| oil | A | 500 | 170 | 40 | OK | 91.0 |
| | B | 5 | 170 | 40 | OK | 98.7 |
| | C | 5 | 170 | 40 | OK | 99.1 |
| Class 2 | none | 0.03 | 200 | 40 | NG | 69.1 |
| No. 2 | A | 5 | 170 | 40 | OK | 96.1 |
| oil | B | 5 | 170 | 40 | OK | 97.0 |
| | C | 5 | 170 | 40 | OK | 97.8 |

From the results of the test described above, it can be seen that undesirable tar components are left when not using a steam source, even when the treatment is applied under high vacuum and high temperatures. Degreasing is possible and the tar components can be eliminated when employing blowing or jetting steam at a vacuum degree of up to about 500 Torr. Although, depending on the kind of oils, the boiling point may be lowered to enhance the cleaning performance by mixing a small amount of a solvent capable of forming an azeotropic mixture with oils as a steam source. The cleaning performance is further enhanced by adding a slight amount of a surface active agent. Further, the separated oils can be recovered by the oil-water separation device 14 and only non-toxic water may be discharged.

Although explanations have been made in the foregoing embodiment with reference to a heat treatment step, the present invention is not so restricted but, rather, deposited oils can be degreased in other steps.

Furthermore, the object to be cleaned is not necessarily limited only to meta materials. Rather, the present invention is also applicable to non-metallic materials.

As has been described above, according to the present invention, since a cleaning liquid comprising mainly steam is blown into a tightly closed system and a treatment is applied under a reduced pressure, there is provided a degreasing and cleaning method and apparatus therefor which causes no public pollution and which is capable of saving energy. Moreover, the present invention can degrease and clean deposited oils at a relatively low temperature and without using toxic chloro-solvents, circumstance-polluting fluoro-solvents or alkali agents and which can recover removed oils.

Having, thus, described the invention, what is claimed is:

1. A degreasing and cleaning method comprising:

heating an object deposited with oils to a temperature in the range of about 100° C. to about 250° C., the object to be cleaned being disposed in a container;

spraying a cleaning liquid comprising at least one liquid selected from the group consisting of water and steam into said container; and subsequently evacuating the container to reduce the pressure in the inside of said container, thereby evaporating the deposited oils to remove them from said object to be cleaned.

2. A degreasing and cleaning method as defined in claim 1, wherein the cleaning liquid is only water or steam.

3. A degreasing and cleaning method as defined in claim 1, wherein the cleaning liquid further comprises: at least one of a substance capable of forming an azeotropic mixture iwth oils or (b) a surface active agent.

4. The method of claim 3 wherein:

the at least one substance is a surface active agent.

5. The method of claim 4 wherein:

the surface active agent is either a nonionic, anionic, cationic or amphoteric surface active agent or mixtures thereof.

6. The method of claim 3, wherein:

the at least one substance is capable of forming an azeotropic mixture, and is selected from the group consisting of benzene and methanol.

* * * * *